United States Patent [19]

Takagi et al.

[11] Patent Number: 4,803,142

[45] Date of Patent: Feb. 7, 1989

[54] CONTAINING MAGNETIC PARTICLES HAVING A BULK RESISTIVITY OF AT MOST $10^4$ OHM.CM AND A POWDER RESISTIVITY OF $10^5$-$10^{12}$ OHM.CM

[75] Inventors: Seiichi Takagi, Yokohama; Hiroshi Fukumoto, Kawasaki, both of Japan

[73] Assignee: Canon Kabushiki Kaisha, Tokyo, Japan

[21] Appl. No.: 922,310

[22] Filed: Oct. 23, 1986

[30] Foreign Application Priority Data

Oct. 28, 1985 [JP] Japan ..... 60-240755

[51] Int. Cl.[4] ..... G03G 9/14

[52] U.S. Cl. ..... 430/106.6

[58] Field of Search ..... 430/106.6, 107, 109, 430/110, 903

[56] References Cited

U.S. PATENT DOCUMENTS 4,436,802 3/1984 Ohtsuka et al. ..... 430/106.6
4,451,837 5/1984 Gruber et al. ..... 430/106.6
4,487,825 12/1984 Gruber et al. ..... 430/106.6
4,654,287 3/1987 Okuyama et al. ..... 430/106.6

FOREIGN PATENT DOCUMENTS 1114249 5/1986 Japan .
1123858 6/1986 Japan .

*Primary Examiner*—John L. Goodrow
*Attorney, Agent, or Firm*—Fitzpatrick, Cella, Harper & Scinto

[57] ABSTRACT

A magnetic toner for developing characteristic latent images is disclosed. The magnetic toner has a magnetic material content W (wt. %) of 20–60 wt. %, a saturation magnetization $\sigma_s$ of W emu/g or higher as measured at a magnetic field of 10 k Öe, and a bulk resistivity of $10^{13}$ Ω.cm or higher. Because of the combination of a high $\sigma_s$ and a high resistivity, the magnetic toner has good image forming characteristics including image density, reproducibility of thin lines and transferability under various environmental conditions and for a long period of image formation.

17 Claims, No Drawings

CONTAINING MAGNETIC PARTICLES HAVING A BULK RESISTIVITY OF AT MOST $10^4$ OHM.CM AND A POWDER RESISTIVITY OF $10^5$-$10^{12}$ OHM.CM

FIELD OF THE INVENTION AND RELATED ART

The present invention relates to a toner for developing electrostatic images in electrophotography, electrostatic recording, electrostatic printing, etc., particularly an insulating magnetic toner for use in such processes.

Hitherto, a large number of electrophotographic processes have been known, as disclosed in U.S. Pat. Nos. 2,297,691; 3,666,363; 4,071,361, and others. In these processes, an electric latent image is formed on a photosensitive member comprising a photoconductive material by various means, then the latent image is developed and visualized with a toner, and the resultant toner image is, after transferred onto paper, etc., as desired, fixed by heating, pressing, etc.

Various developing methods for visualizing electrostatic latent images have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, those developing methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner,have been proposed. Among these, there are many excellent developing methods using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image to effect development. In this method, at the development zone, an electroconductive path is formed with toner particles between the recording member surface and the sleeve surface and the toner particles are attached to image portions due to a Coulomb's force exerted from the image portions to effect development. This method using an electroconductive magnetic toner is an excellent method which has obviated the problems involved in the two-component developing methods. However, as the toner is electroconductive, there is involved a problem that it is difficult to transfer the developed image electrostatically from the recording member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained and is difficult to reduce into a commercial practice.

As another method using a high resistivity magnetic toner, there are known methods wherein toner particles are triboelectrically charged through friction between toner particles or friction between a friction member such as a sleeve and toner particles, and then caused to contact an electrostatic image-bearing member to effect development. However, these methods involve problems that the triboelectric charge is liable to be insufficient because the amount of friction between the toner particles and the friction member, and the charged toner particles are liable to agglomerate on the sleeve because of an enhanced Coulomb's force, so that it is difficult to reduce these methods to a commercial practice.

However, a developing method which addresses the above described problems has been proposed in U.S. Pat. No. 4,473,627. In this method, a magnetic toner is applied in a very small thickness on a sleeve, triboelectrically charged and is brought to an extreme vicinity to an electrostatic image of effect development. More specifically, in this method, an excellent image is obtained through such factors that a sufficient triboelectric charge can be obtained because a magnetic toner is applied onto a sleeve in a very small thickness to increase the opportunity of contact between the sleeve and the toner; the toner is carried by a magnetic force, and the magnet and the toner are relatively moved to disintegrate the agglomerate of the toner and cause sufficient friction between the toner and the sleeve; and the toner is carried by the magnetic force and the carried toner is caused to force an electrostatic image without contact to effect development, so that ground fog is avoided.

Problems to be solved by the Invention

A magnetic toner used in such a one-component developing method is required to have appropriate electrostatic property, electric property and magnetic property.

Especially when individual toner particles do not have equally and appropriately controlled and stabilized charge and magnetic property, the resultant images can have too high an image density or can be so thin that they are difficult to read during successive use or due to change in environmental conditions. Further, in such a case, their can sometimes be observed a phenomenon of fog that the image quality is deteriorated through staining of background. This is phenomenon caused by change in developing characteristic or transfer characteristic, but the relationship thereof with the toner properties has not necessarily been clarified. Particularly, the physical properties such as the magnetic property and electrical resistivity of a toner might have a great influence on the toner performance but have not been fully considered. Further to say, it is difficult to improve the toner performance through consideration of a single physical property For example, if the resistivity of a toner is lowered in order to stabilize the chargeability of the toner, the transfer characteristic is deteriorated to cause decrease in image density and poor reproducibility of thin lines. If the saturation magnetization $\sigma_s$ of a toner is increased by increasing the content of a magnetic material in order to improve conveyance characteristic of the toner, the resistivity of the toner is naturally lowered to result in poor images.

SUMMARY OF THE INVENTION

In view of the above circumstances, we have made an investigation while noting interaction and synergistic effect of physical properties of a magnetic toner such as the content of a magnetic material, the magnetic property and the resistivity. As a result, we have found that it is possible to obtain a toner having good image formability, image density, developing characteristic and transfer characteristic in combination when it satisfies a particular relationship among the magnetic material content, the saturation magnetization $\sigma_s$ as a magnetic property and the bulk resistivity, thereby to arrive at the present invention.

Accordingly, a general object of the present invention is to provide a magnetic toner having solved the above mentioned problems.

A specific object of the present invention is to provide a magnetic toner providing an image with high image density, good reproducibility of thin lines and excellent gradation characteristic.

A further object of the present invention is to provide a magnetic toner free of change in performances during a long period of use.

Another object of the present invention is to provide a magnetic toner free of change in performances in response to change in environmental conditions.

Still another object of the present invention is to provide a magnetic toner with an excellent transfer characteristic.

According to the present invention, there is provided a magnetic toner having a magnetic material content W (wt. %) in the range of 20–60 wt. %, a saturation magnetization $\sigma_s$ of W·emu/g or larger, and a bulk resistivity of $10^{13}$ Ω·cm or larger.

The above mentioned and other objects and features of the invention will be better understood upon consideration of the following detailed description concluding with specific examples of practice.

DETAILED DESCRIPTION OF THE INVENTION

Without being confined to any particular theory, we have discovered a magnetic toner having good performances in combination by satisfying a particular mutual relationship of physical properties while we are examining characteristics of magnetic toners. Particularly, we have discovered a mutual relationship, the satisfaction of which provides an excellent toner which may have an improved property without inviting corsening of the other properties that are unacceptable for a commercial use or inferior to those of the conventional toners.

More specifically, when the magnetic material content W is 20–60% and $\sigma_s$ is below W·emu/g (as measured at a magnetic field of 10 kÖe) for a magnetic toner, the image characteristics, particularly the gradational characteristic and thin line-reproducibility of the toner become insufficient. This may be attributable to ununiformity of properties of individual toner particles caused by ununiform sizes and shapes of toner ears above a magnetic pole. It may be assumed that the formation of the toner ears depends on the magnetic material content (relating to the weight of a toner particle) and $\sigma_s$ of the toner. While not clarified theoretically, a magnetic toner satisfying the condition of $\sigma_s$ being 1.1×W·emu/g or larger is preferred. It is particularly preferred that the magnetic toner has a $\sigma_s$ which is 1.1×W·emu/g or larger and in the range of 22–110 emu/g.

In this instance, when the magnetic toner has a bulk resistivity of below $10^{13}$ Ω·cm, the transferability of the toner is degraded to result in an unsatisfactory image characteristic. The resistivity is also closely related to the magnetic material content. The bulk resistivity is preferably $10^{14}$ Ω·cm or larger, further preferably $10^{15}$ Ω·cm or larger, particularly preferably $10^{15}$–$10^{16}$ Ω·cm.

The bulk resistivity of a toner may be measured in the same manner as the measurement of the bulk resistivity of a magnetic material as will be described hereinafter.

The content of total iron (metallic iron and iron value in iron compound) and the metallic iron content in the magnetic toner are also important factors in relation to the magnetic material content. In the present invention, it is preferred that the magnetic toner has a total iron content of 0.75 W wt. % or more and a metallic iron content of 0.6 W wt. % or more. If the total iron content is below 0.75 W wt. % and the metallic iron content is below 0.6 W wt. % in the toner, an ill effect is given with respect to the chargeability of the toner, so that there is increased a tendency that an image characteristic is deteriorated, particularly with respect to staining of background. This is assumed to be an influence of oxide or other compounds in the magnetic material but has not been fully clarified as yet. However, the tendency has been clearly observed, and a preferred result is attained when both of the above mentioned total iron content and metallic iron content are satisfied than when either one of these is satisfied. Preferably, the total iron content is 0.85 W wt. % or more, particularly 0.9 W wt. % or more, and the metallic iron content is 0.75 W wt. % or more, particularly 0.8 W wt. % or more.

At the same time, the magnetic material should preferably have a particle size of 1.0 μm or smaller. If the particle size is above 1.0 μm, the image characteristic and transfer characteristic are deteriorated to result in a low image density and a low reproducibility of thin lines due to poor transfer. The particle size is preferably 0.8 μm or smaller, more preferably 0.6 μm or smaller, particularly preferably 0.1–0.5 μm. The particle size is obtained by taking an electron microscopic photograph at a magnification of 10,000–30,000 of particles, selecting 100 particles at random, measuring the sizes of the particles with a measure along the same axis, and averaging the measured sizes.

Furthermore, it is important that the magnetic particles have a specific range of electrical resistivity.

Hitherto, a particular attention has not been paid to the resistivity of a magnetic material. This is presumably because the conventionally used magnetic particles are composed of a material having a high bulk resistivity as represented by magnetite or hematite.

We have found that the resistivity of magnetic particles, which has been overlooked heretofore, has a remarkable influence on toner characteristics for a magnetic material haveing a high metallic iron content which is a preferred example of the magnetic material to be used in the present invention.

As is well known, it is said that an insulating magnetic toner is required to have a bulk resistivity of at least $10^{13}$ Ω·cm or higher. However, it has been considered that such a resistivity value is mainly governed by the characteristic of a resin coating or containing magnetic particles, so that even if the magnetic particles have a remarkably low resistivity, it hardly affects the resistivity of the resultant toner or the triboelectric chargeability of the toner which has been subjected to sufficient friction. We have found, however, that a toner containing such magnetic particles having a low resistivity can have a remarkably lowered developing characteristic in some cases in a dynamic process as is in a developing apparatus of an actual copying machine. The reason for this phenomenon has not been clarified as yet but a principal cause is presumably a lowering in time constant of triboelectrification because the toner contains a low resistivity material. The above mentioned phenomenon is also observed with respect to a magnetic material having a high metallic iron content. While it is known that such a magnetic material has a low bulk resistivity of the order of microohm centimeter, the actual value of the magnetic material is deviated therefrom in many cases because it contains a small quantity of oxide, impurities and other metals. As a standard method for measuring a bulk resistivity of a magnetic material, magnetic particles are pressed by applying a pressure of several hundred kg/cm$^2$ or higher, preferably 300–500 kg/cm$^2$ to obtain a pellet of 2 cm in diameter and 1–3 mm in thickness, the resistivity of which is measured and adopted herein. The resistivity thus measured of ordinary iron oxide powder such as magnetite is $10^6$–$10^9$ Ω·cm, and that of a magnetic material having a high metallic iron content is $10^4$ Ω·cm or lower.

A method for measurement of powder-form resistivity of magnetic particles is now explained. Electrodes for powder measurement (Type SE-43, mfd. by Andoh Denki K.K.) are connected to a pico-anmeter/DC voltage source (Type 4140B, mfd. by Yokogawa Hewlett-Packard K.K.), and the measurement is effected in the atmosphere of high purity air having a dew point of −50° C. or below. The measurement is effected by gradually raising the voltage by a 0.1 V-step (application time: about 1 second), and a current value measured at 100 V is adopted. Sample magnetic particles in an amount of 0.2–1 g, preferably 0.5–1 g, are placed between the above mentioned electrodes (area: 2 cm$^2$) and lightly packed into a thickness of 0.5–2 mm, preferably about 1 mm, and an apparent density of 1.0–3.0 g/cm$^2$, preferably 1.0–2.0 g/cm$^2$, and the measurement of the above mentioned voltage and current values is effected. From the measured values, a powder-form apparent resistivity is calculated. Incidentally, when the powder resistivity of a toner is measured, a sample toner of 0.5–1 g is lightly packed into a thickness of about 1 mm and an apparent density of 0.7–1 g/cm$^3$.

The magnetic material preferably used in the present invention shows a powder-form resistivity of $10^5$–$10^{12}$ Ω·cm.

Further, the magnetic material preferably used in the present invention shows a bulk resistivity of $10^4$ Ω·cm or lower. If the bulk resistivity is above $10^4$ Ω·cm, the resultant toner has an increased tendency that a lowering in image density or staining of background occurs during a long period of use or due to a change in environmental conditions, particularly under a low humidity condition. Further, when the powder resistivity is below $10^5$ Ω·cm, the resultant image density becomes very low. On the other hand, when it is above $10^{12}$ Ω·cm, there arises an increased tendency of causing background staining. More preferably, the bulk resistivity is $10^3$ Ω·cm or below, further preferably $10^2$ Ω·cm or below, particularly preferably 1–10 Ω·cm.

The powder resistivity is preferably $10^6$–$10^{10}$ Ω·cm, further preferably $10^6$–$10^9$ Ω·cm.

Further, a magnetic material containing an iron compound such as iron fluoride provides an improved chargeability, particularly an improved chargeability under various environmental conditions, especially under a high humidity condition to obviate change in image quality. Specific forms of the iron fluoride include $Fe_2F_5$, $FeF_3$ and $FeF_2$. The content is preferably 0.1–40 wt. %, further preferably 0.5–20 wt. %, particularly preferably 2–10 wt. %. $FeF_2$ is especially preferred as the iron fluoride, and the content is preferably 0.1–30 wt. %, more preferably 0.5–20 wt. %, particularly preferably 2–10 wt. %.

In order to have the magnetic material contain iron fluoride, for example, a magnetic material of, e.g., an oxide form may be, after reduction into metallic iron as a pretreatment or simultaneously with the reduction, reacted with HF, $NH_4F$ or $NH_4HF_2$. If the magnetic material contains much metallic iron, it may be directly reacted with HF, $NH_4F$ or $NH_4HF_2$. The reaction temperature is 300°–650° C., preferably 350°–600° C. In the present invention, a magnetic material having a structure comprising a core of metallic iron oxide and an outer surface of iron fluoride is preferred in respects of environmental stability and electrical properties. In order to increase the moisture resistance, it is also preferred to surface-treat a magnetic material having an outer surface of iron fluoride further with a hydrophobicity-imparting agent such as a silane coupling agent or a titanium coupling agent. A titanium coupling agent generally has a higher hydrophobicity-imparting ability than a silane coupling agent.

Examples of the binder resin constituting the magnetic toner according to the present invention include: homopolymers or copolymers of styrene and its derivatives such as polystyrene, pol-p-chlorostyrene, polyvinyltoluene, styrene-p-chlorostyrene copolymer; copolymers of styrene and acrylic acid esters such as styrene-methyl acrylate copolymer, styrene-ethyl acrylate copolymer, styrene-n-butyl acrylate copolymer; copolymers of styrene and methacrylic acid esters such as styrene-methyl methacrylate copolymer, styrene-ethyl methacrylate copolymer, styrene-n-butyl methacrylate copolymer; multi-component copolymers of styrene, acrylic acid esters and methacrylic acid esters; copolymers of styrene and other vinyl monomers such as styrene-acrylonitrile copolymer, styrene-vinyl methyl ether copolymer, styrene-butadiene copolymer, styrenevinyl methyl ketone copolymer, styrene-acrylonitrileindene copolymer, styrene-maleic acid ester copolymer, styrene-dimethylaminoethyl methacrylate copolymer; polymethyl methacrylate, polybutyl methacrylate, polyvinyl acetate, polyesters, polyamides, epoxy resins, polyvinyl butyral, polyacrylic acid resin, phenolic resins, aliphatic or alicyclic hydrocarbon resins, petroleum resin, chlorinated paraffin, etc. These binder resins may be used either singly or as a mixture. The magnetic toner according to the present invention may preferably contain 25–150 wt. parts of the magnetic material per 100 wt. parts of the binder resin.

The polymer, copolymer or polymer blend constituting the toner binder resin may preferably contain 40 wt. % or more of a vinyl aromatic monomer or an acrylic monomer. Particularly, a binder resin comprising 40–100 wt. % ff a copolymer of styrene and a (meth)acrylic acid ester (an ester of (meth)acrylic acid and a $C_1$–$C_8$ alcohol) is preferred in respects of durability, fixability and chargeability of the toner.

Further, examples of the binder resin for providing a toner for pressure-fixing system include: low-molecular weight polyethylene, low-molecular weight polypropylene, various natural waxes, synthetic waxes, ethylene-vinyl acetate copolymer, ethyleneacrylic acid ester copolymer, higher fatty acids, polyamide resins, and polyester resins. These resins may be used singly or in mixture. A further preferable result may be attained by using a wax selected from waxes containing paraffins as a predominant constituent such as paraffin wax, microcrystalline wax; polyolefin waxes containing polyolefins such as polyethylene or polypropylene as a predominant constituent; and natural waxes such as montan wax and carnauba wax in an amount of 50 wt. % or more of the binder resin.

Optional materials such as a charge controller, a colorant and a flowability improver may preferably be added as desired. The charge controller and the flowability improver may be incorporated in toner particles (internal addition), mixed with toner particles (external addition) or added in a combination of both ways. The charge controller may for example be a metal-containing dye or nigrosine. The colorant may comprise conventionally known dyes or pigments. The flowability improver may for example be colloidal silica or a fatty acid metal salt. It is also possible to incorporate fillers such as calcium carbonate and fine powdery silica in an amount of 0.5–20 wt. % of a toner as extenders. Further, a flowability improver such as teflon powder may be added in order to disintegrate agglomerate of toner particles to improve the flowability. It is also a preferred embodiment of the present invention to add a waxy material such as low-molecular weight polyethylene, low-molecular weight polypropylene, microcrystalline wax, carnauba wax, sasol wax or paraffin wax in an amount of about 0.5–5 wt. %.

The magnetic toner according to the present invention may be produced by sufficiently mixing and kneading the components thereof by hot kneading means such as heat rollers, kneader and extruders, followed by mechanical pulverization and classification; by dispersing components such as the magnetic material in a binder resin solution, followed by spray drying; or by mixing in a monomer providing the binder resin the other prescribed ingredients to form a suspension or emulsion, followed by polymerization.

SYNTHESIS EXAMPLE 1

1 kg of magnetite ($Fe_3O_4$) having an average particle size of 0.8 μm was charged in a retort furnace and heated to 400° C. in the presence of an $N_2$ gas stream, and an $H_2$ gas stream was substituted for the $N_2$ gas stream. The $H_2$ gas stream was controlled at a rate of 45 l/min. and passed for about 4 hours. After that, the $H_2$ gas stream was replaced by an $N_2$ gas stream and by a mixed gas stream of $N_2$ gas and HF gas in a ratio of 1.1:1.0 which was passed at a rate of 4 l/min. for 25 min. Then, only the $N_2$ gas was caused to flow, and the system was cooled to room temperature to obtain magnetic material A.

The magnetic material A was confirmed to contain iron fluoride by means of an X ray analyzer. The total iron content was 91 wt. % and the metallic iron content was 86 wt. %. According to the measurement by a scanning type electron microscope, the particle size was found to be about 0.9 μm. The bulk resistivity was $10^2$ Ω·cm and the powder resistivity was $10^6$ Ω·cm.

In substantially the same manner as described above, four magnetic materials B, C, D and E were prepared. The respective conditions and the physical properties of the magnetic material thus obtained are inclusively shown in the following Tables 1 and 2.

TABLE 1

| Sample | Size of charged magnetic material (μm) | $H_2$ gas flow time (hrs.) | Fluorination gas | Gas flow time (min.) | Average particle size (μm) | Total iron content (wt. %) |
|---|---|---|---|---|---|---|
| B | 0.7 | about 3 | HF | 18 | 0.8 | 87 |
| C | 0.5 | about 3.5 | $NH_4F$ | 25 | 0.55 | 88 |
| D | 0.5 | about 2.5 | $XH_4HF_2$ | 35 | 0.55 | 75 |
| E | 0.4 | about 4 | HF | 35 | 0.5 | 84 |

TABLE 2

| Sample | Metallic iron content (wt. %) | Bulk resistivity (Ω · cm) | Power resistivity (Ω · cm) |
|---|---|---|---|
| B | 79 | $10^3$ | $10^7$ |
| C | 80 | $10^2$ | $10^8$ |
| D | 60 | $10^4$ | $10^9$ |
| E | 75 | $10^3$ | $10^8$ |

EXAMPLE 1

A dry one-component insulating magnetic toner was prepared in the same manner as the conventional pulverization process based on the following prescription.

| | |
|---|---|
| Polystyrene resin (D-125, mfd. by Shell Sekiyu Kagaku K.K.) | 62 wt. % |
| Nigrosin dye (Bontron N-07, mfd. by Orient Kagaku K.K.) | 2 wt. % |
| Magnetic material A | 34 wt. % |

The above ingredients were weighed to provide a total weight of 2 kg and subjected to powder blend by means of a 10 l-Henschel mixer. The blend was coarsely pulverized by a 2 mm-mesh speed mill and finely pulverized by a jet mill, followed by classification by a wind force classifier (mfd. by Alpine Co.) into a prescribed particle size.

The thus obtained toner had a volume-average particle size of 11.5 μm with about 1.0 % by volume of 20.2 μm or larger and 18% by number of 6.35 μm or smaller according to particle size measurement by a Coulter counter Model TA-II with a 100 μ-aperture.

The toner was powder-blended with 0.5% of colloidal silica (RA-200H, mfd. by Aerosil K.K.).

The toner thus obtained showed a saturation magnetization $\sigma_s$ of 40 emu/g at a magnetic field of 10 k Öe, a bulk resistivity of $1.2\times10^{15}$ Ω·cm, a total iron content of 31 wt. %, and a metallic iron content of about 29 wt. %.

The toner was used for a long period of imaging of 50000 sheets by means of a copying machine (NP-150, mfd. by Canon K.K.).

As a result, the image density was retained in the range of 1.3±0.05 according to measurement by a refractive densitometer (McBeth), and a resolution of 6.3 lines/mm was obtained. Further, even when the environmental conditions were changed to high temperature-high humidity (32.5° C.-90%) and to low temperature-low-humidity (15° C.-10%), substantially no change in performance was observed. The transfer characteristic was also good, providing a transfer rate of about 95% on a weight basis.

COMPARATIVE EXAMPLE 1

A toner was prepared in the same manner as in Example 1 except that the magnetic material A was replaced by a commercially available magnetic material (EPT-1000, mfd. by Toda Kogyo K.K.). The thus obtained toner had a volume average particle size of 11.6 μm with 0.8% by volume of 20.2 μm or larger and 16% by number of 6.35 μm or smaller. The particle size distribution may be considered substantially the same as that obtained in Example 1. The toner showed a saturation magnetization $\sigma_s$ of 20 emu/g (<W=34).

The toner was used for a long period of imaging by means of NP-150, whereby a change in image density was observed, particularly the image density being lowered from 1.3 at the initial stage to 1.1 at the time of copying about 5000 sheets. The resolution was 4.0 lines/mm and the transfer rate was 80 wt. %, being clearly inferior to those obtained in Example 1.

EXAMPLE 2

| | |
|---|---|
| Styrene-butyl methacrylate (wt. ratio = 7:3) copolymer (Mw = 320,000, Mn = 20,000) | 66 wt. % |
| Bontron E-81 (Orient Kagaku K.K.) | 1 wt. % |
| Magnetic powder B | 33 wt. % |

A toner was prepared in the same manner as in Example 1 based on the above prescription.

The particle size was substantially the same as in Example 1. The toner was powder-blended with colloidal silica (R-972, mfd. by Aerosil K.K.).

The thus obtained toner showed a saturation magnetization of about 400 emu/g, a bulk resistivity of $8.9\times10^{14}$ Ω·cm, a total iron content of 30 wt. %, and a metallic iron content of 26 wt. %.

The toner was used for a long period of imaging to produce 70,000 sheets by means of an NP-300 RE copier (mfd. by Canon K.K.), whereby the image density was retained in the range of 1.2±0.05. Substantially no change in performance was observed under the high temperature-high humidity conditions and low temperature-low humidity conditions. The resolution was as high as 6.3 lines/mm and the transfer rate was as good as 93 wt. %.

COMPARATIVE EXAMPLE 2

A toner was prepared in the same manner as in Example 2 except that the magnetic material B was replaced by a commercially available magnetic material (BL-100, mfd. by Titan Kogyo K.K.). The $\sigma_s$, total iron content and metallic iron content of the toner were all outside the ranges specified by the present invention.

The toner was used for a long period of imaging by means of the N-3000 RE copier, whereby a somewhat lower image density of 1.05 and a somewhat inferior resolution of 4.0 lines/mm were obtained. Particularly, under the high temperature-high humidity conditions, the image density was lowered to 0.93.

EXAMPLE 3

400 g of styrene, 60 g of dimethylaminoethyl methacrylate, and 240 g of the magnetic material C surface-treated with 8 g of a titanium coupling agent were uniformly mixed for about 20 minutes in a vessel provided with a high shearing force stirrer (TK-homomixer, mfd. by Tokushu Kika Kogyo K.K.). During this period, the temperature was raised to about 50° C., and the magnetic material was dispersed in the monomers. Into the monomers containing the magnetite was mixed 30 g of lauroyl peroxide under stirring. The slurry mixture was charged in 600 g of water with 4 g of colloidal silica (#200, mfd. by Aerosil K.K.) dispersed therein held at 70° C. under stirring by means of a homomixer, and the mixture was further stirred at 4000 r.p.m. for 30 minutes. Then, the reaction mixture was subjected to complete polymerization under stirring by means of a paddle blade. The polymerized product was washed with water, filtrated, and dried to obtain a toner with a volume-average particle size of 12.7μ (by use of Coulter counter with an aperture of 100μ).

The toner showed a saturation magnetization of 36 emu/g, a bulk resistivity of $2.5\times10^{15}$ Ω·cm, a total iron content of 30 wt. % and a metallic iron content of 20 wt. %.

The toner was used for a long period of image with reversal development by means of a commercially available dry electrophotographic printer (NP-200J, Canon K.K.), whereby an image density of 1.2±0.05 was retained, and the environmental characteristics, transfer characteristic and resolution were all satisfactory. factory.

EXAMPLE 4

| | |
|---|---|
| Styrene-butyl methacrylate (8:2) copolymer (Mw = 300,000, Mn = 15,000) | 58 wt. % |
| Styrene-butadiene (9:1) copolymer (Mw = 200,000, Mn = 20,000) | 6 wt. % |
| Polypropylene (Mn = 3,000) | 3 wt. % |
| Nigrosine dye (Bontron N-07, mfd. by Orient Kagaku K.K.) | 1 wt. % |
| Magnetic material E | 32 wt. % |

A toner was prepared in the same manner as in Example 1.

The toner was powder-blended with 0.5 wt. % of RA-200 H (mfd. by Aerosil K.K.), 0.03 wt. % of zinc stearate, and 1.0 wt. % of cerium oxide.

The toner showed a $\sigma_s$ of 39 emu/g, a bulk resistivity of $2.8\times10^{14}$ Ω·cm, a total iron content of 27 wt. % and a metallic iron content of 24 wt. %.

The toner was used for a long period of image formation of 50,000 sheets by means of an NP-150Z copier, whereby an image density of 1.3±0.05 was retained, and the environmental characteristics and transfer characteristic were also good. Particularly, the resolution was 6.3 lines/mm or higher, and photographic images were reproduced very well.

What is claimed is:

1. A magnetic toner composition, comprising: a binder resin and a particulate magnetic material comprising metallic iron and iron fluoride, said magnetic particles being less than about 1.0 μm and having a bulk resistivity of $10^4$ Ω·cm or less and a powder resistivity of $10^5 10^{12}$ Ω·cm, wherein said magnetic toner composition has a magnetic material content W of from 20–60 wt. %, a saturation magnetization $\sigma_s$ of W emu/g or higher as measured at a magnetic filed of 10 k Oe and a bulk resistivity of $10^{13}$ Ω·cm or higher.

2. The magnetic toner composition according to claim 1, which has a total iron content of 0.75×W wt. % or more and a metallic iron content of 0.6×W wt. % or more.

3. The magnetic toner composition ccording to claim 1, wherein said iron flouride comprises $Fe_2$.

4. The magnetic toner composition according to claim 2, wherein the saturation magnetization $\sigma_s$ is at least about $1.1 \times W$ emu/g.

5. The magnetic toner composition according to claim 4, wherein the saturation magnetization $\sigma_s$ is between about 22–110 emu/g.

6. The magnetic toner composition according to claim 2, wherein the bulk resistivity is $10^{14}$ Ω·cm or higher.

7. The magnetic toner composition according to claim 6, wherein the bulk resistivity is $10^{15}$ Ω·cm or higher.

8. The magnetic toner composition according to claim 5, wherein the bulk resistivity is between about $10^{15}$ to $10^{16}$ Ω·cm.

9. The magnetic toner composition according to claim 4, wherein the composition has a total iron content of at least about $0.85 \times W$ wt. % and a metallic iron content of at least about $0.75 \times W$ wt. %.

10. The magnetic toner composition according to claim 5, wherein the composition has a total iron content of at least about $0.9 \times W$ wt. % and a metallic iron content of at least about $0.8 \times W$ wt. %.

11. The magnetic toner composition according to claim 4, wherein the magnetic material particles are less than about 0.8 μm.

12. The magnetic toner composition according to claim 11, wherein the magnetic material particles are less than about 6 μm.

13. The magnetic toner composition according to claim 5, wherein the magnetic material particles are between about 0.1–0.5 μm.

14. The magnetic toner composition according to claim 1, wherein the magnetic material has a total iron content of 75 wt. % or more and a metallic iron content of 60 wt. % or more.

15. The magnetic toner composition according to claim 1, which comprises 25 to 150 parts by weight of the magnetic material particles per 100 parts by weight of the binder resin 16. The magnetic toner composition according to claim 1, wherein the magnetic material has structure comprising a core of metalliC iron and an outer surface of iron fluoride.

17. The magnetic toner composition according to clam 6, wherien the iron fluoride comprises $FeF_2$.

* * * * *

UNITED STATES PATENT AND TRADEMARK OFFICE

CERTIFICATE OF CORRECTION

PATENT NO. : 4,803,142

DATED : February 7, 1989

INVENTOR(S) : SEIICHI TAKAGI, ET AL.

It is certified that error appears in the above-identified patent and that said Letters Patent is hereby corrected as shown below:

IN [54] TITLE

"CONTAINING MAGNETIC PARTICLES" should read --TONER CONTAINING MAGNETIC PARTICLES--.

COLUMN 1

Line 1, "CONTAINING MAGNETIC PARTICLES" should read --TONER CONTAINING MAGNETIC PARTICLES--.

COLUMN 2

Line 21, "to" should read --of--.

COLUMN 6

Line 4, "espectially" should read --especially--.
Line 35, "pol-p-chlorostyrene," should read --poly-p-chlorostyrene,--.
Line 65, "ff" should read --of--.

COLUMN 10

Line 60, "$10^5 10^{12}\Omega\cdot$CM," should read --$10^5$-$10^{12}\Omega\cdot$CM,--.

UNITED STATES PATENT AND TRADEMARK OFFICE

CERTIFICATE OF CORRECTION

PATENT NO. : 4,803,142

DATED : February 7, 1989

INVENTOR(S) : SEIICHI TAKAGI, ET AL. Page 2 of 2

It is certified that error appears in the above-identified patent and that said Letters Patent is hereby corrected as shown below:

COLUMN 11

Line 1, "ccording" should read --according--, and "$Fe_2$." should read --$FeF_2$.--.

COLUMN 12

Line 22, "metalliC" should read --metallic--.
Line 25, "clam 6, wherien" should read --claim 16, wherein--.

Signed and Sealed this

Twenty-first Day of November, 1989

*Attest:*

JEFFREY M. SAMUELS

*Attesting Officer* *Acting Commissioner of Patents and Trademarks*